US011796254B1

(12) United States Patent
Chen et al.

(10) Patent No.: US 11,796,254 B1
(45) Date of Patent: Oct. 24, 2023

(54) GRAPHITIZATION FURNACE WITH RAPID ACTIVE COOLING SYSTEM

(71) Applicant: Hunan Youre Technology Co., LTD., Hunan (CN)

(72) Inventors: Yan Chen, Hunan (CN); Dongsheng Chen, Hunan (CN); Xin Tang, Hunan (CN); Shunlong Li, Hunan (CN); Guangwei Zhou, Hunan (CN)

(73) Assignee: Hunan Youre Technology Co., LTD., Changsha (CN)

( * ) Notice: Subject to any disclaimer, the term of this patent is extended or adjusted under 35 U.S.C. 154(b) by 0 days.

(21) Appl. No.: 18/214,078

(22) Filed: Jun. 26, 2023

(30) Foreign Application Priority Data

Dec. 15, 2022 (CN) ..... 202211616471.6

(51) Int. Cl.
*F27D 9/00* (2006.01)

(52) U.S. Cl.
CPC ..... *F27D 9/00* (2013.01); *F27D 2009/0005* (2013.01); *F27D 2009/0013* (2013.01); *F27D 2009/0018* (2013.01)

(58) Field of Classification Search
CPC ..... F27D 9/00; F27D 2009/0005; F27D 2009/0013; F27D 2009/0018
USPC ..... 165/168
See application file for complete search history.

(56) References Cited

U.S. PATENT DOCUMENTS

| | | | | |
|---|---|---|---|---|
| 5,097,890 | A * | 3/1992 | Nakao | F27D 9/00 219/390 |
| 8,507,296 | B2 * | 8/2013 | Ueno | H01L 21/67109 438/795 |
| 9,587,884 | B2 * | 3/2017 | Kosugi | F27B 17/0025 |
| 11,043,402 | B2 * | 6/2021 | Kosugi | F27D 9/00 |
| 11,131,004 | B2 * | 9/2021 | Thevenet | C21D 9/561 |
| 11,367,633 | B2 * | 6/2022 | Yamaguchi | C23C 16/45578 |
| 2001/0016306 | A1 * | 8/2001 | Vader | C30B 25/14 432/2 |
| 2008/0296282 | A1 * | 12/2008 | Kobayashi | F27B 17/0025 219/385 |
| 2009/0014435 | A1 * | 1/2009 | Hayashida | H01L 21/67109 29/25.01 |
| 2009/0194521 | A1 * | 8/2009 | Kobayashi | F27B 17/0025 219/520 |
| 2009/0197352 | A1 * | 8/2009 | Ueno | H01L 21/67109 438/5 |

(Continued)

*Primary Examiner* — Jon T. Schermerhorn, Jr.
(74) *Attorney, Agent, or Firm* — Lawrence N. Ginsberg

(57) ABSTRACT

A graphitization furnace with a rapid active cooling system is disclosed, including a furnace body and an active cooling system. The active cooling system is provided with at least one medium loop unit and a control unit for controlling a flow velocity of a medium in the medium loop unit, each medium loop unit includes a plurality of heat removal pipes pre-embedded in a furnace cavity of the furnace body, and each heat removal pipe is provided with a medium flow channel communicated with the medium loop unit. The graphitization furnace with a rapid active cooling system can realize rapid active cooling, short turnover time and high energy utilization efficiency of the graphitization furnace, and has wide applicability, which is not only suitable for construction of a new graphitization furnace, but also suitable for transformation of the existing Acheson graphitization furnace.

7 Claims, 7 Drawing Sheets

(56) References Cited

U.S. PATENT DOCUMENTS

| | | | | |
|---|---|---|---|---|
| 2014/0238972 | A1* | 8/2014 | Yoshii | F27D 21/0014 219/486 |
| 2015/0093909 | A1* | 4/2015 | Murata | C23C 16/46 438/758 |
| 2015/0370245 | A1* | 12/2015 | Sugishita | H01L 21/67109 700/121 |
| 2019/0276938 | A1* | 9/2019 | Sugishita | C23C 16/466 |

* cited by examiner

GRAPHITIZATION FURNACE WITH RAPID ACTIVE COOLING SYSTEM

CROSS-REFERENCE TO RELATED APPLICATION

This application is based on and claims the benefit of priority from Chinese Patent Application No. 2022116164716, filed on 15 Dec. 2022, the entirety of which is incorporated by reference herein.

TECHNICAL FIELD

The disclosure belongs to the technical field of graphitization furnaces, and particularly relates to a graphitization furnace with a rapid active cooling system.

BACKGROUND

Graphitization furnace belongs to a section in the production of artificial graphite with the largest cost, pollution and energy consumption. At present, Acheson graphitization furnace is mainly used in the graphite industry for the production of graphite and carbon materials. In the production process of the Acheson graphitization furnace, the maximum temperature in the furnace reaches 2,800° C., and the temperature of a thermal insulation layer is above 1,000° C. After heating, the graphitization furnace is naturally cooled usually and then discharging is performed. The cooling time is very long, usually as long as 30-40 days, which may even reach over 60 days in some cases, and the thermal energy utilization rate is as low as zero. Furthermore, the thermal energy may also cause serious thermal pollution.

There are two main development directions in improving the production efficiency and thermal energy utilization of the graphitization furnace, wherein one development direction is to use a continuous graphitization furnace solution, and the other development direction is to accelerate the cooling of the graphitization furnace. The former development direction has small production capacity and large energy consumption. The latter development direction mainly carries out active cooling on outer sides of refractory bricks of a furnace wall or movable layer-by-layer cooling on a furnace top after blowing out at present, which is complicated in operation and has low effectiveness. The two main development directions both have certain limitations.

SUMMARY

The disclosure aims at solving at least one of the above-mentioned technical problems in the existing technology. Therefore, the disclosure provides a graphitization furnace with a rapid active cooling system, which realizes one-time cooling by directly cooling a material body inside the graphitization furnace without the need for cooling layer by layer, and can realize faster cooling efficiency and heat exchange efficiency in comparison to a traditional cooling mode.

A graphitization furnace with a rapid active cooling system according to an embodiment of the disclosure comprises a furnace body and an active cooling system, wherein the active cooling system is provided with at least one medium loop unit and a control unit for controlling a flow velocity of a medium in the medium loop unit, each medium loop unit comprises a plurality of heat removal pipes pre-embedded in a furnace cavity of the furnace body, and each of the heat removal pipes is provided with a medium flow channel communicated with the medium loop unit.

The graphitization furnace with a rapid active cooling system according to the embodiment of the disclosure at least has the following beneficial effects.

According to the graphitization furnace with a rapid active cooling system in the disclosure, the heat removal pipe is pre-embedded in a high-temperature material pile of the furnace body, the control unit for supplying and controlling a cooling medium to the heat removal pipe is provided at the same time. When the graphitization furnace is in a heating and thermal insulation stage, the cooling medium may be controlled to be at a minimum circulating flow velocity, and is only used for preventing a pipe wall of the heat removal pipe from being overheated, while the flow velocity of the medium is increased in a cooling stage to realize functions of heat removal from the furnace and cooling acceleration, and the heated cooling medium may be used for heat release in other use scenarios or used as a reserve heat source. Therefore, the graphitization furnace with a rapid active cooling system in the disclosure can realize rapid active cooling, short turnover time and high energy utilization efficiency of the graphitization furnace, and has wide applicability, which is not only suitable for construction of a new graphitization furnace, but also suitable for transformation of the existing Acheson graphitization furnace.

According to some embodiments of the disclosure, the medium loop unit is provided with a medium input pipe and a medium output pipe, a medium inlet of the medium flow channel is connected with the medium input pipe, a medium outlet of the medium flow channel is connected with the medium output pipe, and the control unit comprises a medium pump, an input control assembly for controlling the medium input pipe and an output control assembly for controlling the medium output pipe.

According to some embodiments of the disclosure, the input control assembly and the output control assembly are both provided with a flow regulating valve, a thermometer, a pressure gauge and a flow meter.

According to some embodiments of the disclosure, the furnace body is of a cuboid van-type structure, two narrow ends of the furnace body are each provided with an electrode, a furnace core and a thermal insulation layer located on two sides of the furnace core are formed in the furnace cavity of the furnace body, and the heat removal pipes are vertically pre-embedded in the thermal insulation layer.

According to some embodiments of the disclosure, each of the heat removal pipes has a pipe structure having an outer diameter of 0.01 m to 0.5 m and a length of 0.2 m to 6 m and tolerating a temperature above 600° C.

According to some embodiments of the disclosure, a depth of each of the heat removal pipes inserted into a material body is 0.1 m to 5 m.

According to some embodiments of the disclosure, a distance from each of the heat removal pipes to a furnace wall of the furnace body is 0 m to 0.6 m, and an interval between two adjacent heat removal pipes is 0.3 m to 10 m.

According to some embodiments of the disclosure, the heat removal pipes are mounted on a fixed bracket, and the fixed bracket is mounted on a pre-embedding member in the furnace wall of the furnace body or arranged on a steel frame outside the furnace body.

According to some embodiments of the disclosure, each of the heat removal pipes comprises:

a pipe body assembly, wherein the medium flow channel is arranged in the pipe body assembly; and a quartz pipe sleeved around the pipe body assembly or an insulating heat-resistant layer arranged on an outer surface of the pipe body assembly.

According to some embodiments of the disclosure, the heat removal pipes pre-embedded in the thermal insulation layer at a same side of the furnace body are distributed side by side or distributed in multiple rows.

Additional aspects and advantages of the disclosure will be given in part in the following description, and will become apparent in part from the following description, or will be learned through the practice of the disclosure.

BRIEF DESCRIPTION OF THE DRAWINGS

The disclosure will be further explained with reference to the accompanying drawings and embodiments hereinafter, wherein.

DETAILED DESCRIPTION

Figure 1:
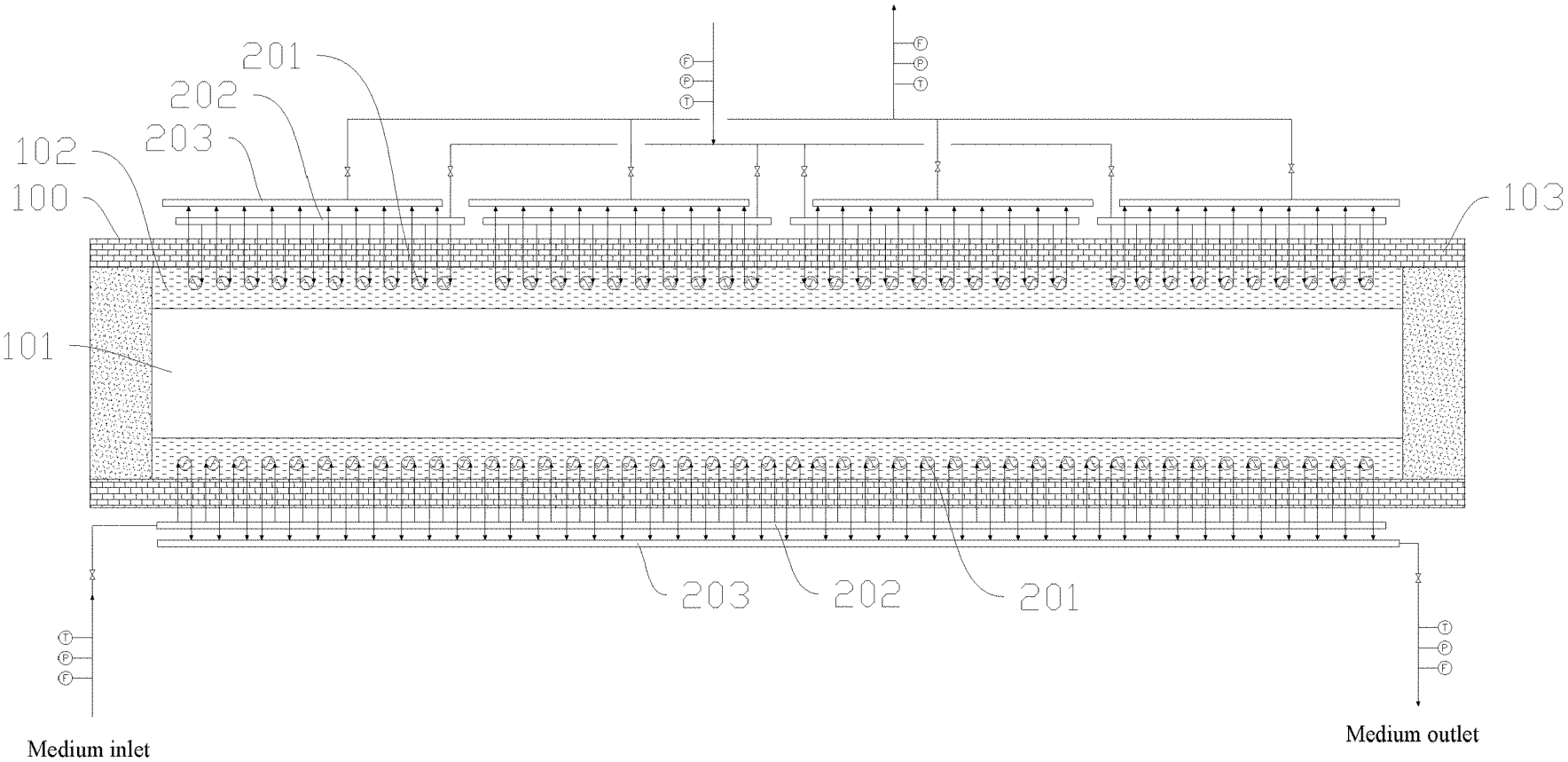
FIG. 1 is a schematic diagram of an overall structure of a furnace body in the disclosure.
Figure 2:
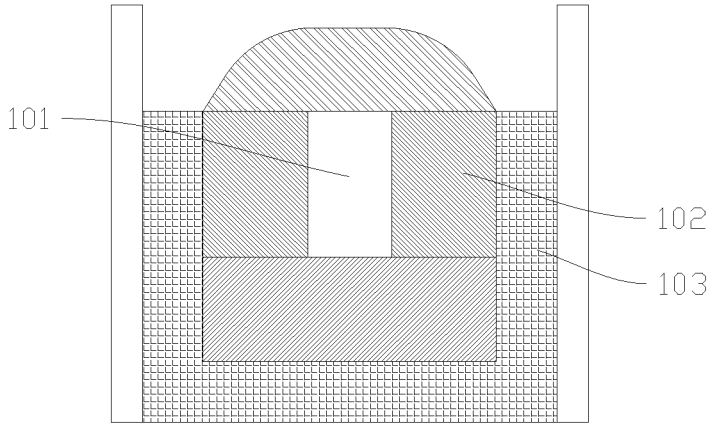
FIG. 2 is a schematic structural diagram of the furnace body in a width direction.
Figure 3:
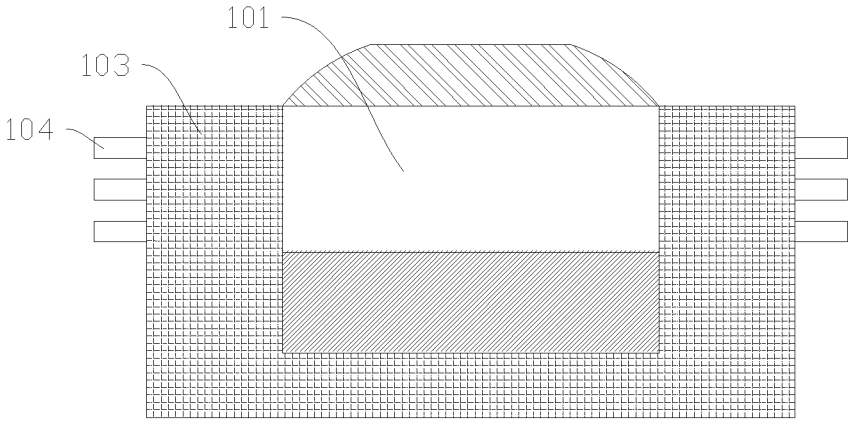
FIG. 3 is a schematic structural diagram of the furnace body in a length direction.
Figure 4:
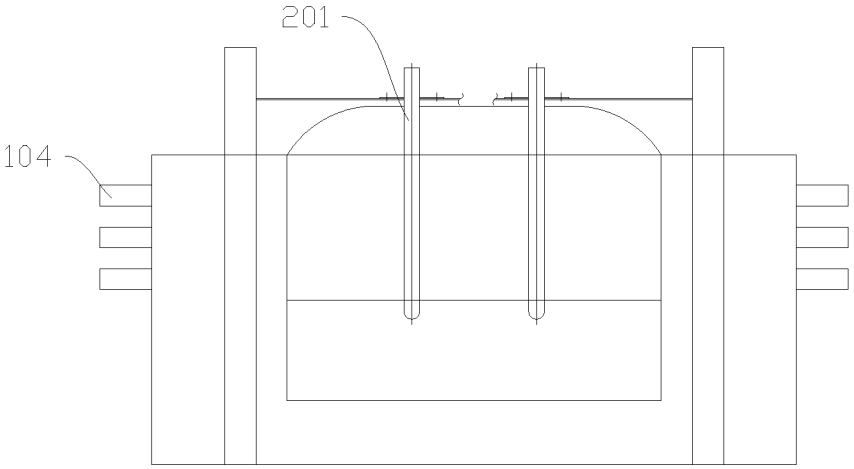
FIG. 4 is a schematic diagram of vertical mounting of heat removal pipes in the length direction of the furnace body.
Figure 5:
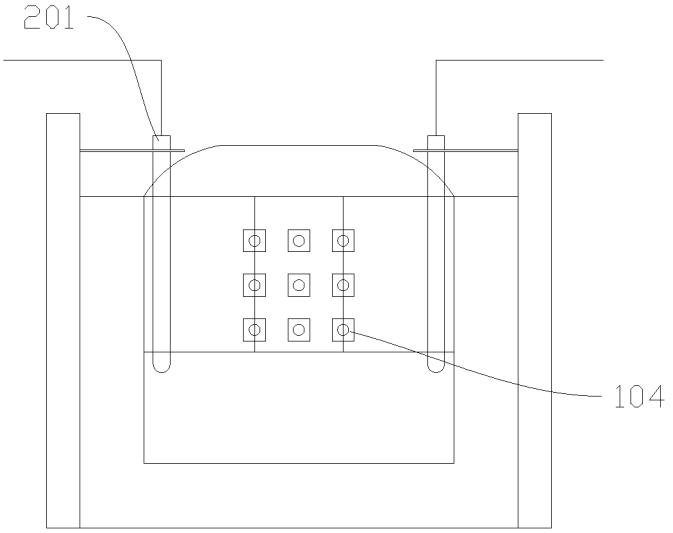
FIG. 5 is a schematic diagram of vertical mounting of heat removal pipes in the width direction of the furnace body.

The embodiments of the disclosure are described in detail hereinafter, examples of the embodiments are shown in the drawings, and the same or similar reference numerals throughout the drawings denote the same or similar elements or elements having the same or similar functions. The embodiments described below by reference to the accompanying drawings are exemplary and are intended only to explain the disclosure and are not to be construed as limiting the disclosure.

In the description of the disclosure, it should be understood that the orientation or position relation related to the orientation description, such as the orientation or position relation indicated by upper, lower, etc. is based on the orientation or position relation shown in the drawings, which is only used for the convenience of description of the disclosure and simplification of description instead of indicating or implying that the indicated device or element must have a specific orientation, and be constructed and operated in a specific orientation, and thus should not be understood as a limitation to the disclosure.

In the description of the disclosure, "a plurality of" means two or more. If first and second are described, the descriptions are used for the purpose of distinguishing the technical features only, and cannot be understood as indicating or implying relative importance, or implicitly indicating the number of technical features indicated thereby, or implicitly indicating the order of technical features indicated thereby.

In the description of the disclosure, unless otherwise explicitly defined, the terms "setting", "mounting" and "connecting" should be understood in a broad sense, and those having ordinary skills in the art can reasonably determine the specific meanings of the above terms in the disclosure in combination with the specific contents of the technical solution.

With reference to FIG. 1 to FIG. 9, a graphitization furnace with a rapid active cooling system according to an embodiment of the disclosure comprises a furnace body 100 and an active cooling system. The active cooling system is provided with at least one medium loop unit and a control unit for controlling a flow velocity of a medium in the medium loop unit, each medium loop unit comprises a plurality of heat removal pipes 201 pre-embedded in a furnace cavity of the furnace body 100, and each of the heat removal pipes 201 is provided with a medium flow channel communicated with the medium loop unit. It should be noted that the pre-embedment of the heat removal pipe 201 does not mean that the heat removal pipe 201 is fixed through a pre-embedding member in a furnace wall 103 of the furnace body 100, or pre-embedded in the furnace wall 103, but is located in the furnace cavity of the furnace body 100, while the pre-embedment of the heat removal pipe 201 means the "pre-embedment" realized by material pile stacking after a thermal insulation material and a raw material are filled into the furnace body 100 during production operation. That is, the pre-embedment of the heat removal pipe 201 refers to a state of the graphitization furnace filled with the material pile relative to a working state, rather than the furnace body 100 in an empty state.

It is to be understood that the furnace body 100 of the graphitization furnace usually is of a cuboid van-type structure usually, the medium loop unit is preferably arranged on two sides of a long end of the furnace body 100, and one or more medium loop units may be arranged in a length direction of the furnace body 100 according to an actual size and a design condition of a medium loop. When a plurality of medium loop units are adopted, if one certain medium loop unit needs to be maintained due to leakage and other cases, a single medium loop unit may be shut down quickly without affecting the working of other units, which is suitable for a condition that the medium has a high leakage risk. However, using one medium loop unit is more suitable for a condition that the medium has a good stability and a low leakage risk. Certainly, a detachable connection structure may also be provided for each heat removal pipe 201 to control the opening, closing and isolation of each heat removal pipe 201 independently.

According to the graphitization furnace with a rapid active cooling system in the disclosure, the heat removal pipes 201 are pre-embedded in a high-temperature material pile of the furnace body 100, and the control unit for supplying and controlling a cooling medium to the heat removal pipes 201 is provided at the same time. When the graphitization furnace is in a heating and thermal insulation stage, the cooling medium may be controlled to be at a minimum circulating flow velocity, and is only used for preventing a pipe wall of the heat removal pipe 201 from being overheated, while the flow velocity of the medium is increased in a cooling stage to realize functions of heat removal from the furnace and cooling acceleration, and the heated cooling medium may be used for heat release in other use scenarios or used as a reserve heat source. Therefore, the graphitization furnace with a rapid active cooling system in the disclosure can realize rapid active cooling, short turnover time and high energy utilization efficiency of the graphitization furnace, and has wide applicability, which is not only suitable for construction of a new graphitization furnace, but also suitable for transformation of the existing Acheson graphitization furnace. Moreover, it is to be understood that the cooling medium is not limited to water, molten salt, carbon dioxide, nitrogen or other gases.

In some embodiments of the disclosure, the medium loop unit is provided with a medium input pipe 202 and a medium output pipe 203, and the heat removal pipes 201 of the same medium loop unit are correspondingly connected with the medium input pipe 202 and the medium output pipe 203. Specifically, a medium inlet of the medium flow channel inside each heat removal pipe 201 is connected with the medium input pipe 202 and a medium outlet of the medium flow channel inside each heat removal pipe is connected with the medium output pipe 203. The control unit comprises a medium pump, an input control assembly for controlling the medium input pipe 202 and an output control assembly for controlling the medium output pipe 203. The input control assembly and the output control assembly comprise but are not limited to one of a flow regulating valve, a thermometer, a pressure gauge, or a flow meter. Those having ordinary skills in the art may set the input control assembly and the output control assembly flexibly according to actual needs. According to the graphitization furnace with a rapid active cooling system in the embodiment, power for circulating the cooling medium is provided through the medium pump, and the pumped cooling medium enters each heat removal pipe 201 of the same unit from the medium input pipe 202, and is led out from the medium output pipe 203 after heat exchange in the furnace. In this period, a state of the cooling medium entering the heat removal pipe 201 and a state of the cooling medium sent out from the heat removal pipe 201 may be detected through the flow regulating valve, the thermometer, the pressure gauge or the flow meter to comprehensively judge heat removal and heating conditions in the heat removal pipe 201, and then a pumping velocity and a flow rate are reversely adjusted to ensure that the heat removal pipe 201 is in a normal heating state, thus avoiding an overheating damage, and also avoiding the cooling medium from being overheated in the heat removal pipe 201 to damage the heat removal pipe 201.

It should be noted that in actual setting, input ends and output ends of the plurality of medium loop units located at the same side of the furnace body 100 may be connected with the same input header pipe and the same output header pipe respectively, and then the input control assembly and the output control assembly are arranged corresponding to the input header pipe and the output header pipe, thus reducing device cost. The input control assembly and the output control assembly may also be set for each medium loop unit to improve monitoring accuracy and timeliness of a working state of each medium loop unit. For example, when a certain heat removal pipe 201 has a leakage point, a pressure and a temperature of the medium outlet pipe 203 may be affected, and then an abnormality may occur compared with other medium loop units, and may be found out in this case. Moreover, the medium loop unit may be isolated to avoid further leakage.

In some embodiments of the disclosure, two narrow ends of the furnace body 100 are each provided with an electrode 104, a furnace core 101 and a thermal insulation layers 102 located at two sides of the furnace core 101 are formed in the furnace cavity of the furnace body 100, and the heat removal pipes 201 are vertically pre-embedded in the thermal insulation layer 102. As the temperature of the furnace core 101 is the highest, and can reach 2,000° C. in the heating and thermal insulation stage of the Acheson graphitization furnace, while the temperature of the thermal insulation layer 102 made of a thermal insulation material is much lower, and is only 1,000° C., it will not pose too great design difficulty to the heat removal pipes 201 in case that the heat removal pipes 201 are pre-embedded in the thermal insulation layer 102, which can ensure the implementation and normal operation of the heat removal pipes 201.

It may be understood that, according to different sizes of the actual furnace body 100, different cooling requirements, different types of the graphitization furnace, different machining conditions, and the like, each of the heat removal pipes 201 may have a pipe structure having an outer diameter of 0.01 m to 0.5 m and a length of 0.2 m to 6 m and tolerating a temperature above 600° C. Moreover, a depth of each of the heat removal pipes 201 inserted into a material body is 0.1 m to 5 m. Meanwhile, according to different widths of the thermal insulation layer 102, a distance from each of the heat removal pipes 201 to a furnace wall 103 of the furnace body 100 is 0 m to 0.6 m, and according to different lengths of the thermal insulation layer 102, an interval between two adjacent heat removal pipes 201 is 0.3 m to 10 m.

Because it is not necessary to arrange only one row of heat removal pipes 201 at the same side of the furnace core 101, which means that the heat removal pipes 201 located at the same side of the furnace core 101 may be distributed in multiple rows, an interval between two adjacent rows of heat removal pipes 201 may be set first in this case, then the interval between two adjacent heat removal pipes 201 in the same row is set, and the interval between two adjacent heat removal pipes 201 is not limited to one value. For example, two different intervals are set among three heat removal pipes 201 in the same row, and thus there is no conflict with the interval setting described above.

In some embodiments of the disclosure, the heat removal pipes 201 are mounted on a fixed bracket, and the fixed bracket is mounted on a pre-embedding member in the furnace wall 103 of the furnace body 100, thus maintaining the heat removal pipes 201 fixed in the furnace cavity. The pre-embedding member is set when building the furnace wall 103.

In other embodiments of the disclosure, the fixed bracket is arranged on a steel frame outside the furnace body 100. The fixed bracket and the steel frame are connected by crossing from an upper end of the furnace wall 103.

In some embodiments of the disclosure, each of the heat removal pipes 201 is provided with a pipe body assembly, and the medium flow channel is arranged in the pipe body assembly, such as a U-shaped pipe, a sleeve and other structures. Moreover, each of the heat removal pipes 201 comprises a quartz pipe 2011 sleeved around the pipe body assembly, or an insulating heat-resistant layer arranged on an outer surface of the pipe body assembly. As two ends of the Acheson graphitization furnace are each provided with the electrode 104, there are electric field and magnetic field environments in the furnace cavity. By arranging the quartz pipe 2011 or the insulating heat-resistant layer, the influence by the electric field and the magnetic field in a high-temperature material field can be avoided, and the influence to the normal heating and thermal insulation of the graphitization furnace can also be avoided.

Figure 9:
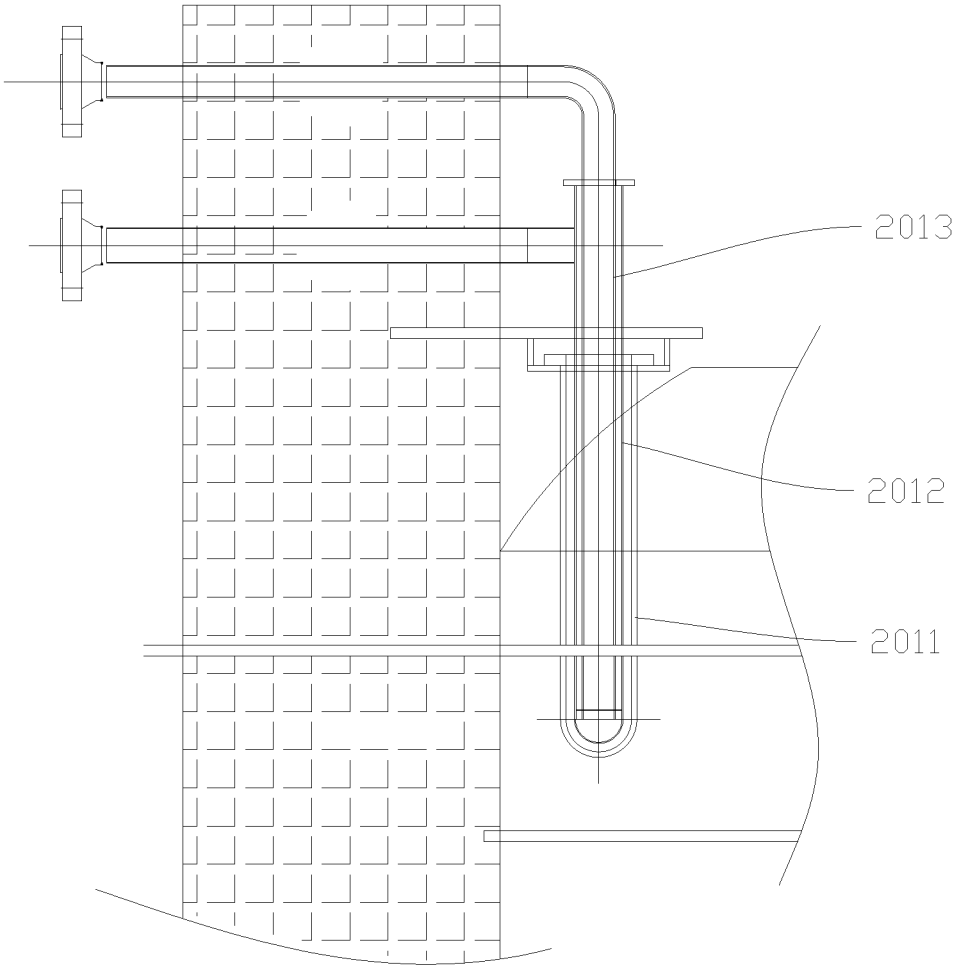
FIG. 9 is a schematic structural diagram of the heat removal pipe.

Referring to FIG. 9, in some embodiments of the disclosure, the pipe body assembly is coaxially provided with a cooling inner pipe 2013 and a cooling outer pipe 2012. An upper end of the cooling inner pipe 2013 is provided with an inlet and a lower end of the cooling inner pipe 2013 is provided with an opening. The cooling outer pipe 2012 is sleeved around the cooling inner pipe 2013, and the cooling outer pipe 2012 is provided with an outlet. The cooling medium is led into the cooling inner pipe 2013 through the inlet, flows downwardly through the opening at the lower end of the cooling inner pipe 2013 to enter the cooling outer pipe 2012, and then is led out upwardly from the outlet, thus forming the medium flow channel.

When the quartz tube 2011 is sleeved around the cooling outer pipe 2012, the cooling outer pipe 2012 may be an alloy pipe made of a material tolerating a temperature above 500° C., while the cooling inner pipe 2013 may be made of a wider range of materials because the cooling medium flows through inner and outer surfaces of the cooling inner pipe, and may tolerate a temperature lower than 500° C. Moreover, an interval is kept between the quartz pipe 2011 and the cooling outer pipe 2012. When the quartz pipe 2011 is adopted, the pipe body assembly is heated by heat radiation, which realizes stable heat absorption and uniform heating.

On the basis of the setting of the quartz pipe 2011 above, a heat absorption layer is provided on a surface of the cooling outer pipe 2012 to improve heat exchange efficiency. Specifically, a ceramic energy-saving coating layer with high-temperature far infrared radiation resistance is adopted. A thickness of the coating layer is preferably 50 μm to 500 μm.

When the insulating heat-resistant layer is arranged on an outer surface of the cooling outer pipe 2012, the insulating heat-resistant layer may be a nano-composite high-temperature resistant coating layer arranged on the surface of the cooling outer pipe 2012, and a thickness of the nano-composite high-temperature resistant coating layer is 50 μm to 500 μm. In addition, the cooling outer pipe 2012 may be an alloy pipe made of a material tolerating a temperature above 1,000° C. as there is no quartz pipe 2011 for thermal isolation.

In some embodiments of the disclosure, a side wall of the cooling inner pipe 2013 is provided with a plurality of disturbing holes, the disturbing holes are circumferentially arranged at an angle with respect to the pipe wall of the cooling inner pipe 2013, and a disturbing assembly is arranged between the cooling inner pipe 2013 and the cooling outer pipe 2012. The disturbing assembly is used for distributing and disturbing the flow in a part of the medium passage between the cooling inner pipe 2013 and the cooling outer pipe 2012. In the embodiment, the heat exchange efficiency can be improved by arranging the disturbing holes, thus avoiding local film boiling. Meanwhile, in combination with a disturbing function of the disturbing assembly, not only the mounting stability of the cooling inner pipe 2013 can be ensured, but also the disturbing effect can be improved in cooperation with the disturbing holes, thus avoiding film boiling, and thereby improving the heat exchange efficiency.

In some embodiments of the disclosure, a radial included angle between each of the disturbing holes and the cooling inner pipe 2013 is 20° to 70°, and the disturbing holes are arranged at an interval of 10 cm to 200 cm in an axial direction of the cooling inner pipe 2013.

In some embodiments of the disclosure, the disturbing assembly is provided with a plurality of stator blades. Preferably, a length direction of each of the stator blades extends in an axial direction and a circumferential direction of the cooling inner pipe 2013, thus forming a form of blade spirally twisted with respect to the cooling inner pipe 2013. Moreover, multiple levels of (i.e., multiple) stator blades are arranged in the axial direction of the cooling inner pipe 2013, and twisting angles of two levels of adjacent stator blades are opposite to each other.

Embodiment 1

Figure 6:
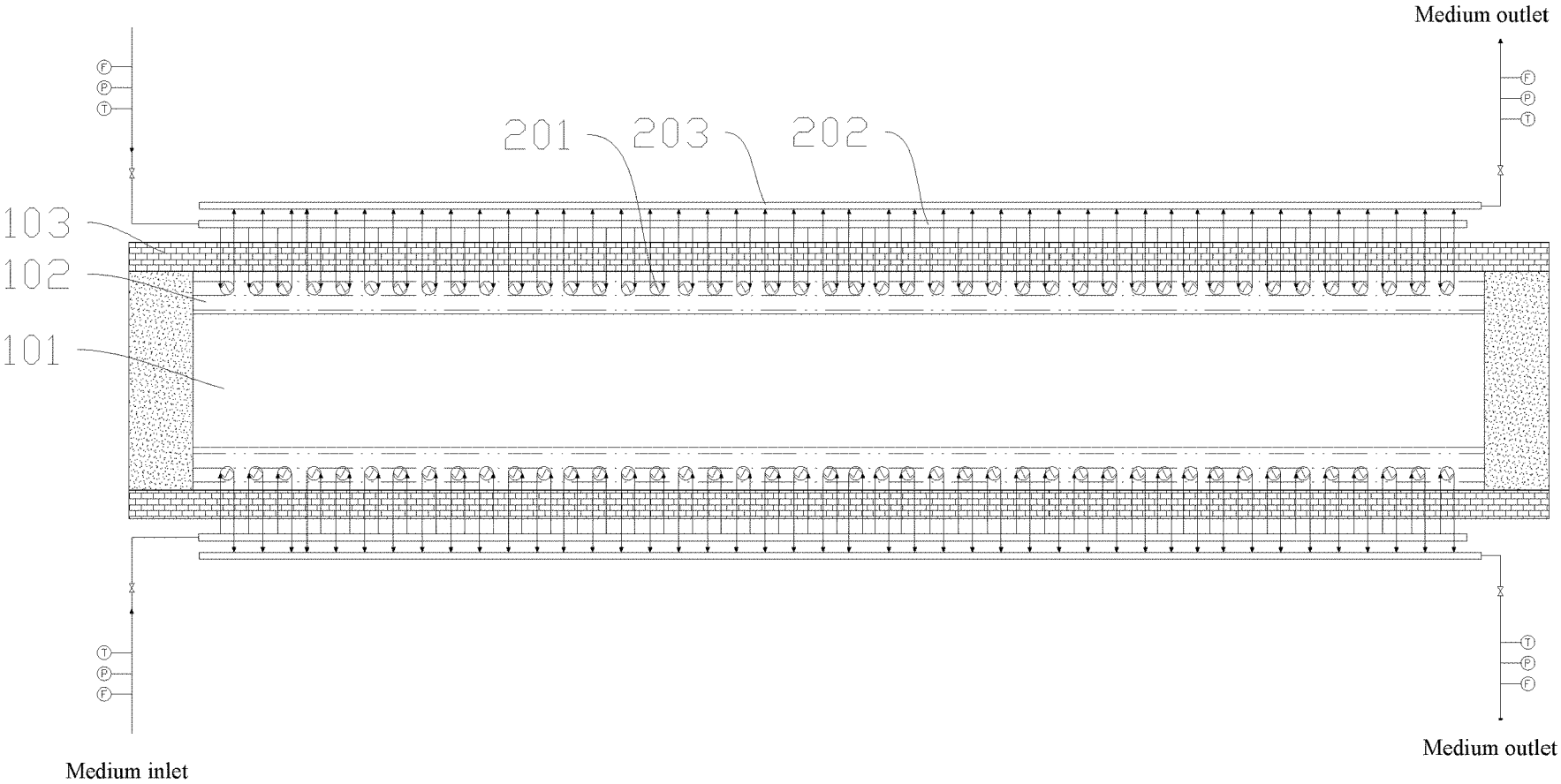
FIG. 6 is a schematic diagram of one structural setting in which the cooling medium is molten salt.

Referring to FIG. 6, a graphitization furnace with a rapid active cooling system in this embodiment is provided with a furnace body 100, the furnace body 100 comprises furnace walls 103 composed of refractory bricks, and left and right ends of the furnace body 100 are each provided with an electrode 104. The furnace walls 103 on front and rear sides of the furnace body 100 are provided with a thermal insulation layer 102 (also known as a thermal isolation layer in the industry) made of a thermal insulation material, and a top portion of the furnace body 100 is provided with a furnace cover made of the thermal insulation material. Outer sides of the front and rear furnace walls 103 of the furnace body 100 are respectively provided with one medium loop unit, and each medium loop unit is provided with one medium input pipe 202 and one medium output pipe 203. Meanwhile, a plurality of heat removal pipes 201 are vertically arranged side by side in a length direction of the furnace body 100 in the thermal insulation layer 102 close to the medium loop unit, and a medium flow channel in each heat removal pipe 201 is connected with the medium input pipe 202 and the medium output pipe 203 to form a complete passage. The medium input pipe 202 and the medium output pipe 203 are both provided with a flow meter, a pressure gauge, a thermometer and a regulating valve for realizing corresponding monitoring and regulation. Meanwhile, at least the medium input pipe 202 is provided with a medium pump. A molten salt is adopted as a cooling medium in this embodiment. The heat removal pipe 201 are metal alloy pipes having an out diameter of 0.1 m and a pipe length of 4 m and tolerating a high temperature above 600° C., the heat removal pipes 201 are inserted into a powder body by 3.5 m, a transverse distribution interval between the heat removal pipes 201 is 2 m, and a distance from each of the heat removal pipes 201 to the furnace wall 103 is 0.3 m.

The structural setting in this embodiment has the following advantages:

1) the molten salt medium has stable performances, wide use temperature range, so that the molten salt medium may enter cooling systems on two sides through two header pipes, thus simplifying the structure;
2) the molten salt medium has good heat exchange performance, so that the heat removal pipes 201 are arranged in line, thus being convenient for mounting; and
3) the molten salt has no phase change in heat exchange, is stable in heat exchange, and can resist a strong thermal shock, so that the heat removal pipes 201 are arranged in a center position of the thermal insulation layer 102 with a distance of 0.3 m from the furnace wall 103 and a high temperature, thus enhancing the heat exchange.

Embodiment 2

Figure 7:
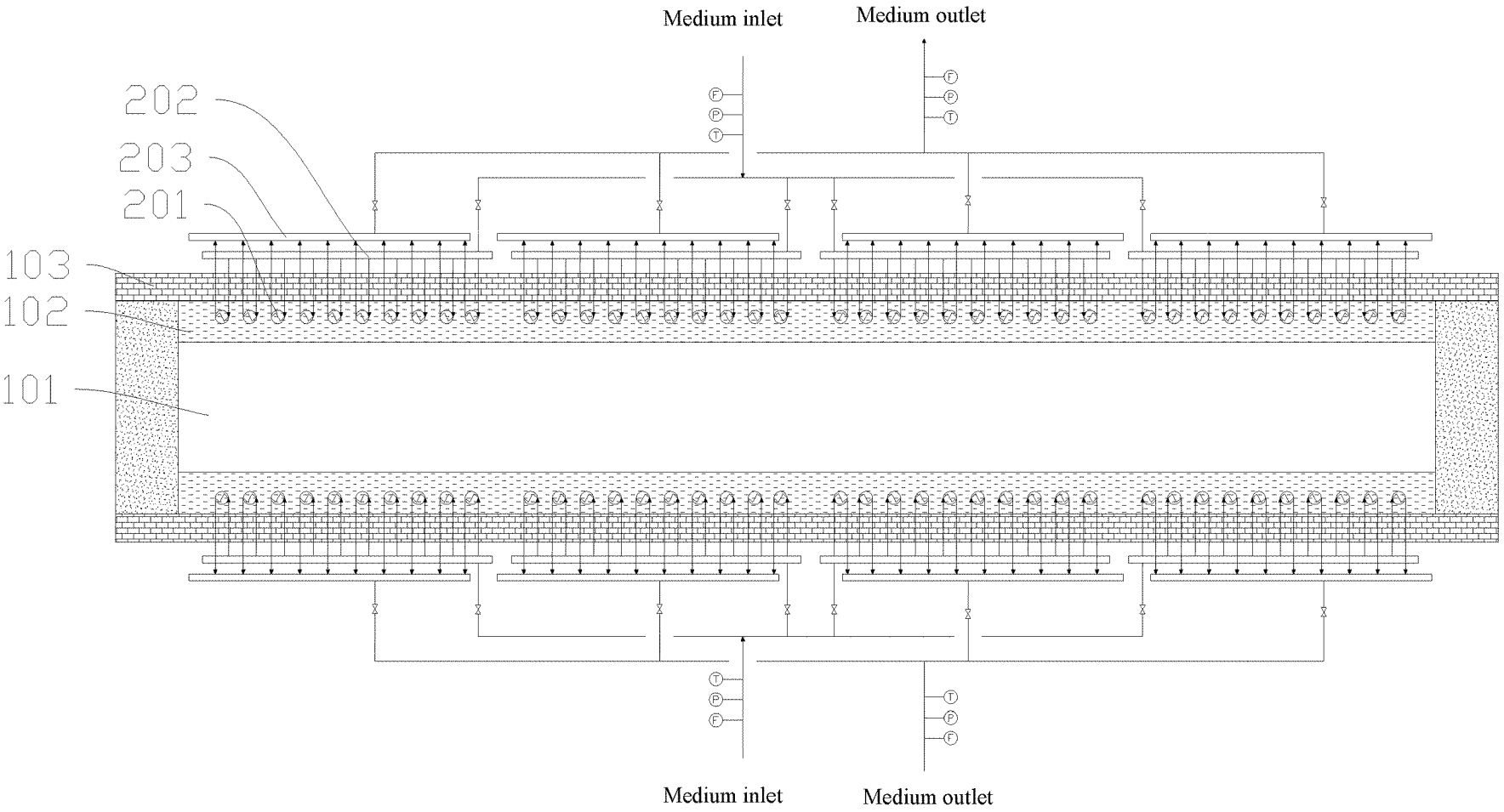
FIG. 7 is a schematic diagram of one structural setting in which the cooling medium is water.

Referring to FIG. 7, a graphitization furnace with a rapid active cooling system in this embodiment is provided with a furnace body 100, the furnace body 100 comprises furnace walls 103 composed of refractory bricks, and left and right ends of the furnace body 100 are each provided with an electrode 104. The furnace walls 103 on front and rear sides of the furnace body 100 are provided with a thermal insulation layer 102 made of a thermal insulation material, and a top portion of the furnace body 100 is provided with a furnace cover made of the thermal insulation material. Outer sides of the front and rear furnace walls 103 of the furnace body 100 are respectively provided with four medium loop units, and each medium loop unit is provided with one medium input pipe 202 and one medium output pipe 203. Meanwhile, a plurality of heat removal pipes 201 are vertically arranged side by side in a length direction of the furnace body 100 in the thermal insulation layer 102 close to the medium loop unit, and a medium flow channel in each heat removal pipe 201 is connected with the medium input pipe 202 and the medium output pipe 203 of the same unit to form a complete passage. Moreover, the four medium loop units at the front side are connected with the same input header pipe and the same output header pipe, and the four medium loop units at the rear side are connected with the same input header pipe and the same output header pipe. Two input header pipes and two output header pipes at the front and rear sides are all provided with a thermometer, a pressure gauge and a flow meter for real-time monitoring. Meanwhile, input and output ends of each medium loop unit are provided with a regulating valve. Water is used as a cooling medium in this embodiment, the heat removal pipes 201 are metal alloy pipes having an out diameter of 0.2 m and a pipe length of 4.5 m and tolerating a high temperature above 600° C., the heat removal pipes 201 are inserted into a powder body by 4 m, a transverse distribution interval between the heat removal pipes 201 is 3 m, and a distance from each of the heat removal pipes 201 to the furnace wall 103 is 0.1 m.

The structural setting in this embodiment has the following advantages:

1) heat exchange of the water medium may have a phase change, and a risk after leakage is high, so that the water medium may enter the furnace walls 103 on two sides for cooling in the above way, and the heat removal pipes 201 of the furnace can be isolated in time in the case of leakage, thus effectively preventing the accident from expanding;
2) the water has good heat exchange performance, so that the heat removal pipes 201 are arranged in line, which can realize quick cooling; and
3) there is a large volume change in the water after the phase change, and heat shock resistance of the system is high, so that the heat removal pipes 201 are arranged in a lower temperature position close to the furnace wall 103 (far away from the furnace core 101).

Embodiment 3

Figure 8:
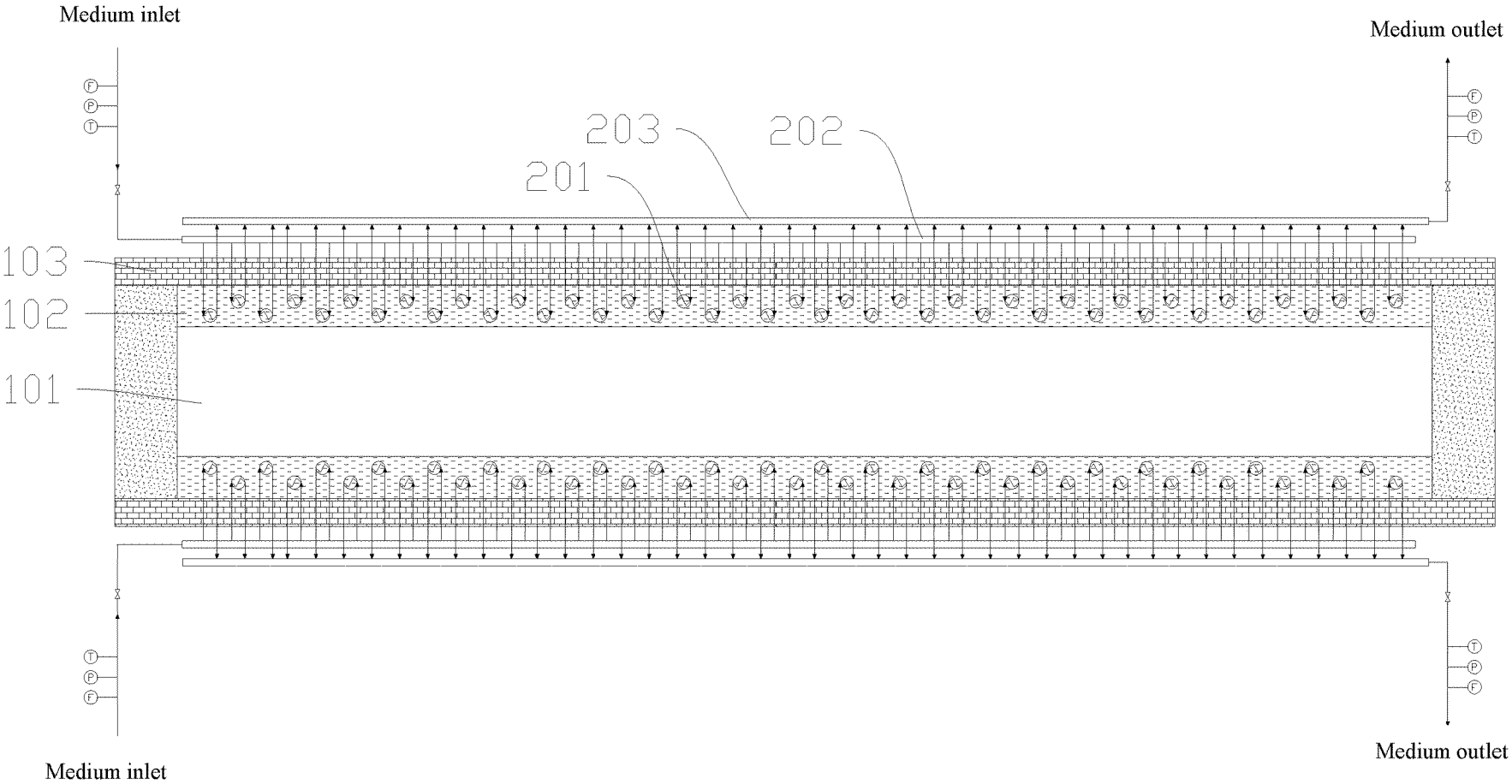
FIG. 8 is a schematic diagram of one structural setting in which the cooling medium is carbon dioxide.

Referring to FIG. 8, a graphitization furnace with a rapid active cooling system in this embodiment is provided with a furnace body 100, the furnace body 100 comprises furnace walls 103 composed of refractory bricks, and left and right ends of the furnace body 100 are each provided with an electrode 104. The furnace walls 103 on front and rear sides of the furnace body 100 are provided with a thermal insulation layer 102 made of a thermal insulation material, and a top portion of the furnace body 100 is provided with a furnace cover made of the thermal insulation material. Outer sides of the front and rear furnace walls 103 of the furnace body 100 are respectively provided with one medium loop unit, and each medium loop unit is provided with one medium input pipe 202 and one medium output pipe 203. Meanwhile, a plurality of heat removal pipes 201 are vertically arranged in a length direction of the furnace body 100 in the thermal insulation layer 102 close to the medium loop unit, wherein the heat removal pipes 201 are arranged in a staggered manner, and a medium flow channel in each heat removal pipe 201 is connected with the medium input pipe 202 and the medium output pipe 203 to form a complete passage. The medium input pipe 202 and the medium output pipe 203 are both provided with a flow meter, a pressure gauge, a thermometer and a regulating valve for realizing corresponding monitoring and regulation. Meanwhile, at least the medium input pipe 202 is provided with a medium pump. Carbon dioxide is adopted as a cooling medium in this embodiment. The heat removal pipes 201 are a metal alloy pipes having an out diameter of 0.15 m and a pipe length of 4 m and tolerating a high temperature above 600° C., the heat removal pipes 201 are inserted into a powder body by 3.5 m, a transverse distribution interval between the heat removal pipes 201 is 1 m, a distance from a row of heat removal pipes 201 close to the furnace wall 103 to the furnace wall 103 is 0.1 m, and a distance from a row of heat removal pipes 201 far away from the furnace wall 103 to the furnace wall 103 is 0.4 m.

The structural setting in this embodiment has the following advantages:

1) the carbon dioxide medium has stable performances, wide use temperature range and low leakage risk, so that the carbon dioxide medium may enter the cooling systems through two header pipes, thus having a simple structure; and
2) the carbon dioxide medium has good heat exchange performance and strong heat shock resistance, thus being suitable for a complex environment where the heat removal pipes 201 are pre-embedded in a high-temperature furnace field, and the heat removal pipes 201 are arranged in a staggered manner, which can increase the number of the heat removal pipes 201 arranged and further improve the heat exchange performance.

The disclosure is described in detail above with reference to the embodiments, but the disclosure is not limited to the above embodiments, and various changes may also be made within the knowledge scope of those of ordinary skills in the art without departing from the purpose of the disclosure.

What is claimed is:

1. A graphitization furnace with a rapid active cooling system, comprising:

a furnace body; and an active cooling system, wherein the active cooling system is provided with at least one medium loop unit and a control unit for controlling a flow velocity of a medium in the medium loop unit, each medium loop unit comprises a plurality of heat removal pipes pre-embedded in a furnace cavity of the furnace body, and each of the heat removal pipes is provided with a medium flow channel communicated with the medium loop unit;

wherein the medium loop unit is provided with a medium input pipe and a medium output pipe, a medium inlet of the medium flow channel is connected with the medium input pipe and a medium outlet of the medium flow channel is connected with the medium output pipe, and the control unit comprises a medium pump, an input control assembly for controlling the medium input pipe and an output control assembly for controlling the medium output pipe;

wherein the input control assembly and the output control assembly are both provided with a flow regulating valve, a thermometer, a pressure gauge and a flow meter; and wherein the furnace body is of a cuboid structure, two narrow ends of the furnace body are provided with an electrode, a furnace core and a thermal insulation layer located on two sides of the furnace core are formed in the furnace cavity of the furnace body, and the heat removal pipes are vertically pre-embedded in the thermal insulation layer.

2. The graphitization furnace with a rapid active cooling system according to claim 1, wherein each of the heat removal pipes has a pipe structure having an outer diameter of 0.01 m to 0.5 m and a length of 0.2 m to 6 m and tolerating a temperature above 600° C.

3. The graphitization furnace with a rapid active cooling system according to claim 1, wherein a depth of each of the heat removal pipes inserted into a material body is 0.1 m to 5 m.

4. The graphitization furnace with a rapid active cooling system according to claim 1, wherein a distance from each of the heat removal pipes to a furnace wall of the furnace body is 0 m to 0.6 m, and an interval between two adjacent heat removal pipes is 0.3 m to 10 m.

5. The graphitization furnace with a rapid active cooling system according to claim 1, wherein the heat removal pipes are mounted on a fixed bracket, and the fixed bracket is mounted on a pre-embedding member in the furnace wall of the furnace body or arranged on a steel frame on an outer side of the furnace body.

6. The graphitization furnace with a rapid active cooling system according to claim 1, wherein each of the heat removal pipes comprises:

a pipe body assembly, wherein the medium flow channel is arranged in the pipe body assembly; and a quartz pipe sleeved around the pipe body assembly or an insulating heat-resistant layer arranged on an outer surface of the pipe body assembly.

7. The graphitization furnace with a rapid active cooling system according to claim 1, wherein the heat removal pipes pre-embedded in the thermal insulation layer on a same side of the furnace body are distributed side by side or distributed in multiple rows.

* * * * *